US005163888A

United States Patent [19]

Stearns

[11] Patent Number: 5,163,888

[45] Date of Patent: Nov. 17, 1992

[54] EXERCISE APPARATUS

[76] Inventor: Kenneth W. Stearns, P.O. Box 55912, Houston, Tex. 77255

[21] Appl. No.: 841,346

[22] Filed: Feb. 25, 1992

[51] Int. Cl.[5] ..... A63B 21/22

[52] U.S. Cl. ..... 482/110; 482/70; 482/52

[58] Field of Search ..... 482/52, 54, 56, 57, 482/63, 70, 71, 72, 92, 93, 110

[56] References Cited

U.S. PATENT DOCUMENTS

| | | | |
|---|---|---|---|
| 3,756,597 | 9/1973 | Monti | 482/110 |
| 4,728,099 | 3/1988 | Pitre | 482/110 |
| 4,900,017 | 2/1990 | Bold | 482/110 |

*Primary Examiner*—Stephen R. Crow
*Attorney, Agent, or Firm*—Dodge, Bush, Moseley & Riddle

[57] ABSTRACT

A resistance device is disclosed for use with exercise equipment such as cross-country ski simulators, stair climbing machines, stationary bicycles and the like. The restraint device includes a rotating assembly disposed about a supporting member such as a rod. The rotating assembly includes a cylinder which is connected by means of a flexible cable or the like to foot pads of the ski simulator or step members of the stair climbing machine, for example, such that to-and-fro or up and down (bi-directional) motion of the exercising machine is converted into angular velocity of the rotating assembly. The rotating assembly includes weighted pivoting members arranged to pivot with respect to the assembly such that with increasing angular velocity of the rotating assembly, the pivots are forced radially outward thereby smoothly increasing the moment-of-inertia of the device. Such moment-of-inertia of the device increases with increasing angular velocity thereby causing the resistance device to increasingly resist increasing velocity of the to-and-fro motion or up and down motion of the exercise machine. Advantageously, the resistance device offers low resistance to motion at low velocity, for example at the start of a stroke of the ski machine, but higher resistance and higher inertia when the stroke is moving at higher speed.

12 Claims, 2 Drawing Sheets

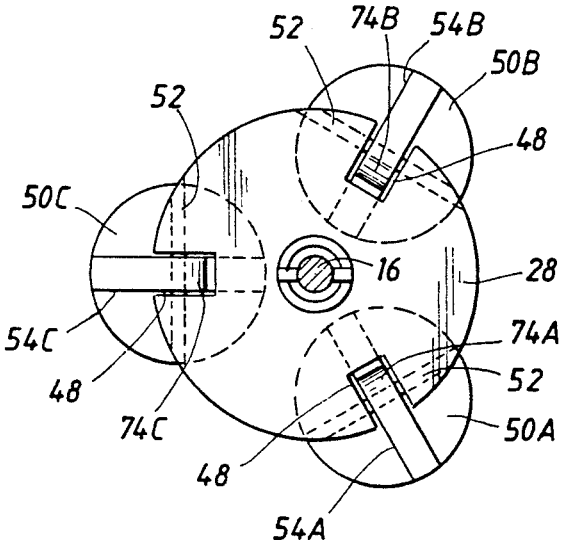
FIG.2
FIG.1
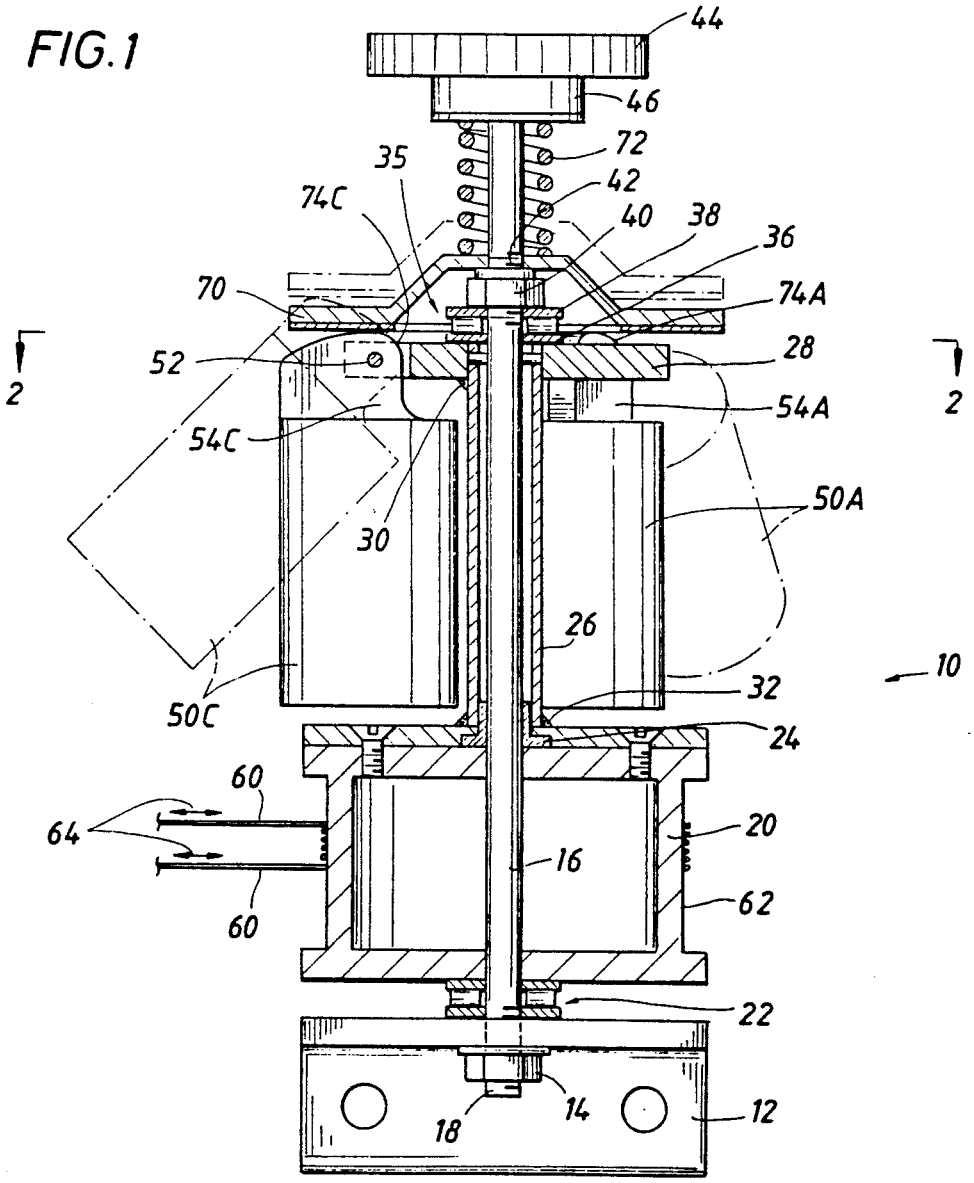

EXERCISE APPARATUS

BACKGROUND OF THE INVENTION

1. Field of Invention

This invention relates generally to exercise apparatus such as a cross-country ski simulator machine or a stair climbing machine. In particular the invention relates to a restraint mechanism for exercise machines by which forces imparted to such a machine by a person are resisted. Still more particularly, the invention relates to a bi-directional restraint mechanism which offers a small restraint at zero or low velocity of a foot pad or step member for example, of an exercise machine, but presents a smooth acting increasing restraint with increasing velocity of said foot pad or step member.

2. Description of the Prior Art

Exercise equipment has used many forms of restraints or resistance to motion so as to enhance the muscle building and toning characteristics on a user of the machines. Weight stacks, springs, and the weight of the exerciser are commonly used to restrain motion of prior machines. Pneumatic or hydraulic damping mechanisms have been used to restrain motion of step members in stair climbing machines and others.

U.S. Pat. No. 4,023,795 illustrates a flywheel and friction brake to restrain foot pad motion of a cross-country ski simulator. Such simulator mounts flywheel on a shaft having rollers which are turned clockwise and counter clockwise on such shaft by skies coupled to the exerciser's foot pad. One way clutches on such rollers impart energy to such shaft in only one direction and only when the roller is energized by forward thrust of one ski at a speed greater than the speed of the shaft which is maintained in rotation by such flywheel. The result is that forward motion of a ski is not inhibited at zero velocity but is inhibited by the effect of the flywheel on the shaft (and of course the friction brake about the flywheel) only at velocities of the ski which match the angular rotation of the shaft and flywheel.

There has developed a need for a restraint device for exercise equipment that is inexpensive to build, which may be used with a variety of exercise machines, and which does not require the use of one way clutches.

3. Identification of Objects of the Invention

The primary object of this invention is to provide a smooth acting restraint device for use with exercise equipment which is characterized by low restraining force in response to low velocity of a foot pad of a ski simulator or a step member of a stair climber, for example, and by increasing restraining force in response to increasing velocity of such members, and is further characterized by equally restraining forces applied to it in opposite directions.

Another object of this invention is to provide a restraint mechanism for exercise equipment which restrains bi-directional motion without the need for one-way clutch mechanisms.

SUMMARY OF THE INVENTION

The resistance apparatus of the invention includes a supporting member with a cylindrical body mounted for rotation with respect to the member. Preferably the supporting member is a rod. The cylindrical member has an outer surface about which may be wrapped a flexible cable connected to foot pads of a cross-country ski simulator or to step members of a stair climber machine, for example. Motion of one foot pad or a step member causes the cylindrical member to rotate in one direction; motion of the other foot pad or other step member causes the cylindrical member to rotate in an opposite direction.

The cylindrical body includes weighted members arranged to pivot outwardly of the cylindrical body and also disposed about the rod. The pivoting members are forced radially outward from the rod due to centrifugal force when the cylindrical body rotates. The pivoting members, when forced radially outwardly, cause the moment of inertia of the cylindrical body to increase with increasing angular velocity. The result is that smoothly increasing resistance to motion is developed to the foot pad or step member with increasing velocity of motion of such members. Such smooth acting increasing resistance to motion is characterized by low restraint or inertia to the exercise device when motion is starting, but relatively higher restraint when the exercise machine is moving at higher speeds.

A biasing mechanism is also provided for increasing the amount of centrifugal force necessary for the pivoting members to be forced radially outward from the rod, thereby reducing the resistance of the device to the motion of the exercise equipment with increasing velocity of such motion.

The invention includes not only the resistance device described above, but a ski simulator exercise machine and a stair climber exercise machine with such resistance device installed to restrain motion respectively of foot pads of the ski simulator and step members of the stair climber.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which:

FIG. 1 is a side view partially in cross-section of the restraining device of the invention, the illustration showing in phantom lines radially outward movement of weighted members in response to bi-directional rotation of the cylindrical body;

FIG. 2 is a view of the device looking downward along lines 2—2 of FIG. 1;

DESCRIPTION OF THE INVENTION

Figure 5:
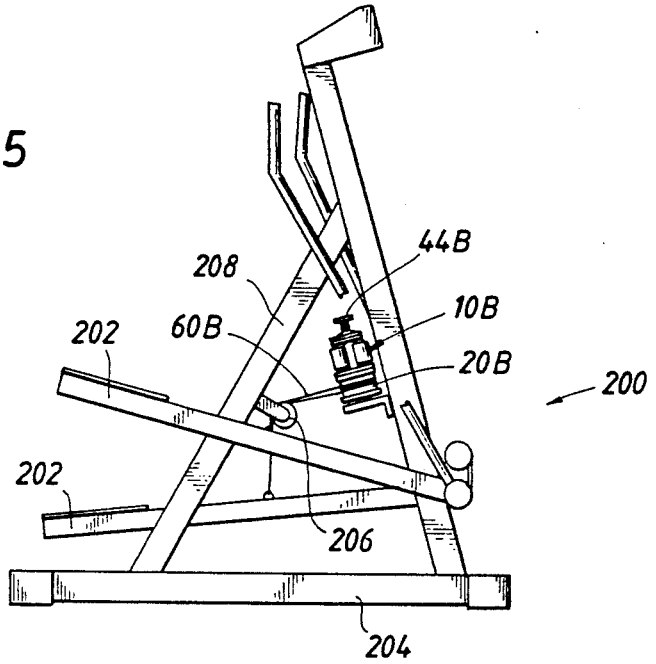
FIG. 5 is a perspective view of a stair climber machine with a restraint device according to the invention installed to resist bi-direction motion of the step members.
Figure 3:
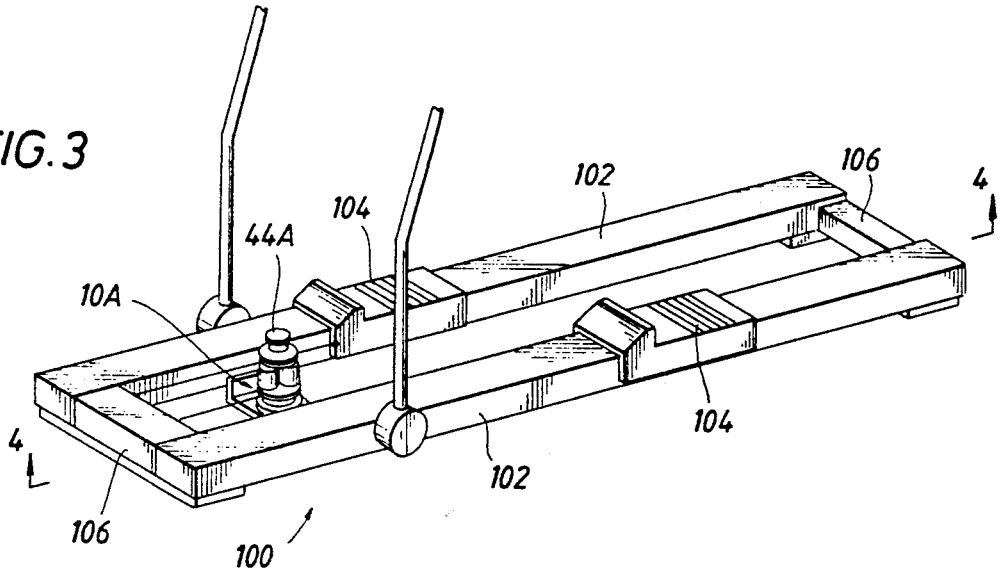
FIG. 3 is a perspective view of a ski simulator machine with a restraining device of the invention installed to resist bi-directional motion of foot pads.
Figure 4:
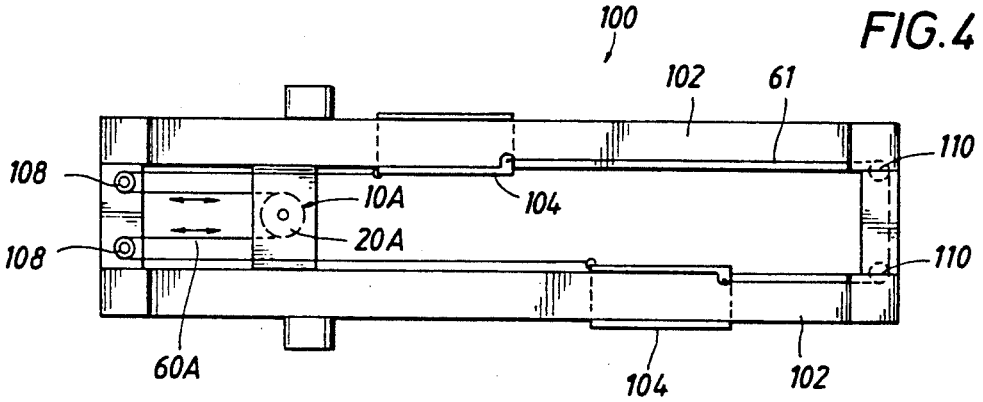
FIG. 4 is a bottom view of the ski simulator of FIG. 3 looking upwardly as indicated by lines 4—4.

FIGS. 1 and 2 illustrate the preferred embodiment of a restraint device 10 adapted to be mounted in an exercise machine such as, for example, the ski simulator exercise machine 100 of FIGS. 3 and 4 or the stair climber exercise machine 200 of FIG. 5. The device 10 of FIG. 1 includes a base 12 having a threaded nut 14 fixed thereto. A supporting member, preferably a rod 16 extends outwardly from the base 12. Such rod 16 includes threads 18 which are screwed into corresponding threads of the nut 14, thereby allowing the rod 16 to move axially a short distance with respect to base 12.

A hollow cylindrical member 20 is disposed about rod 16 and is adapted to rotate with respect to rod 16. Cylindrical body 20 is rotatingly supported with respect to base 12 by means of roller bearing 22 disposed between the bottom of body 20 and the top of base 12. A bushing 24, fixed to the top of cylindrical body 20, aligns cylindrical body 20 with rod 16.

A sleeve 26 is secured by welds 32 to the top of cylindrical body 20 and extends upwardly from body 20 along rod 16. A generally circular disk 28 is secured to the top of sleeve 26 by weld 30. A second roller bearing 35 has a bottom plate 36 secured to a top surface of disk 28, and has a top plate 38 secured to a threaded nut 40. Threads 42 of rod 16 cooperate with corresponding internal threads of a nut 40. A flange 46 and knob 44 are secured to the top of rod 16 by conventional means. Turning of knob 44 and rod 16 causes rod 16 to translate axially within fixed threaded nuts 40 and 14.

As best seen in FIG. 2, disk 28 includes notches 48. Preferably three notches 48 are spaced at equal angular intervals about the periphery of the disk 28. As best seen in FIGS. 1 and 2, three weighted members 50A, 50B and 50C are secured to disk 28 by pin 52 which extend through aligned holes in disk 28 and in connection heads 54A, 54B (not seen in FIG. 1) and 54C of weighted members 50A, 50B and 50C. Such connection heads 54A, 54B, 54C are constructed to fit within notches 48 so as to allow weighted members to rotate radially outwardly as they pivot about pins 52 in response to bi-directional rotation of cylindrical body 20, sleeve 26, disk 28, and weighted members 50A, 50B and 50C.

Rotation of body 20, sleeve 26, disk 28 and weighted members 50A, 50B and 50C results from to-and-fro movement of flexible line 60 which is wrapped about the outer periphery 62 of cylindrical body 20. Such flexible line 60 may be attached to an exercise machine and move in reciprocating motion as indicated by arrows 64, or may move in a single direction (for example, where flexible line 60 is connected to a drive of a stationary bicycle or other such device).

In operation, restraint device 10 offers low resistance to low velocity motion of flexible line 60. As the velocity of line 60 increases, cylindrical body 20 is rotated with increasing angular velocity. Rotation of cylindrical body 20 with sleeve 26 and disk 28 causes weighted members 50A, 50B, 50C to pivot outwardly from disk 28 about pins 52. FIG. 1 shows weighted members 50A and 50C in phantom lines to illustrate their position during rapid rotation.

The outward pivoting of weighted members 50A, 50B, 50C in response to rotation causes the entire device to increase its movement of inertia with respect to a point along the axis of rotation along rod 16. Such increase in movement of inertia acts as a restraint or brake on the force driving flexible line 60 about cylindrical body 20. In other words, such restraint increases and decreases in a smooth non-jerky fashion. The device is characterized by relatively low inertia when a force is initially exerted against it and by relatively high inertia after a force exerted against it increases its rotational velocity. As the velocity of line 60 returns to zero, rotation of restraint device 10 stops, and weighted members 50A, 50B and 50C return to their "at rest" position adjacent sleeve 26. The moment of inertia of the device 10 returns to its low value.

With motion of flexible line 20 in the opposite direction (where for example, line 60 is secured to an exercise device which generates to-an-fro motion) the device 10 offers low restraint to motion at low velocity of line 64 because of its relatively low moment of inertia with weighted member 50A, 50B, 50C adjacent sleeve 26. As the motion of line 60 increases to high velocity in the opposite direction, the weighted members 50A, 50B, 50c again pivot outwardly in response to high angular velocity in the opposite direction of device 10. The result is the same: the moment of inertia of device 10 increases and smoothly acts as a brake on forces tending to drive line 60. As the body 20 again returns to zero angular velocity, weighted members 50A, 50B and 50C pivot to their non-rotating position adjacent sleeve 26 and the moment of inertia of the device returns to a low level.

Apparatus for varying the restraint level of the device 10 includes biasing plate 70 which is disposed about rod 16 above threaded nut 40. A spring 72 is placed between plate 70 and flange 46 such that as knob 44 is turned, rod 16 is caused to move downwardly with respect to disk 28. Spring 72 is compressed, thereby increasing the downward force on biasing plate 70. Biasing plate 70 bears downwardly against top surfaces 74A, 74B and 74C of connection heads 54A, 54B and 54C. Downward force on such top surfaces inhibits the outward pivoting of weighted members 50A, 50B, 50C during rotation of cylindrical body 20, sleeve 26, disk 28 and members 50A, 50B, 50C. As a result, more angular velocity is required to pivot members 50A, 50B, 50C outwardly in order to increase the moment of inertia of the device and its braking effect on flexible line 60. Accordingly, the device provides less braking to rotation of relatively higher velocities with knob 44 screwed inwardly. Turning of the knob 44 in the opposite direction causes the amount of braking at relatively high velocities to be greater.

FIG. 3 illustrates a cross-country ski simulator with restraint device 10A installed to restrain high velocity motions of foot pads 104 along rails 102. Rails 102 are secured in place by cross members 106. As best seen in the bottom view of FIG. 4, a flexible cable 60A is wound about cylindrical body 20A of restraint device 10A and about pulleys 108 and is secured to foot pads 104. Another flexible cable 61 connects foot pads 104 via pulleys 110. Accordingly, as the foot pads 104 move to-and-fro in a push-pull manner, cylindrical body 20A of restraint 10A moves exactly as described above as described with references to FIGS. 1 and 2. The restraint 10A offers only small resistance at zero velocity of foot pads 104, but smoothly acts as a brake during force strokes at higher speeds of foot pads 104. The amount of braking may be adjusted with knob 44A.

FIG. 5 illustrates a stair climbing machine 200 with a restraint device 10B installed to act as a smooth acting restraint or brake during force strokes of foot members 202 as they pivot downwardly with respect to base 204. A flexible line 60B is wrapped about cylindrical body 20B of device 10B and is fixed to step members 202 after passing about idler pulley 206 secured to cross frame 208. The restraint 10B offers only small braking action at zero velocity of foot pads 104, but acts as a brake or restraint during force strokes of higher velocity of step member 202. As before, the amount of braking may be adjusted with knob 44B.

While a preferred embodiment of the present invention has been illustrated in detail, it is apparent that modifications and adaptations of the preferred embodiments will occur to those skilled in the art. For example, rod 16 of FIG. 1 functions as a stationary supporting member to support the members 50A, 50B, 50C which rotate with respect to base 12. Other stationary supporting members could be substituted for rod 26. A first example is that a stiff hollow tube could be substituted for the preferred rod 16. Another example is that a stationary outer frame could be provided, rather than rod 16, to support the rotating members including the drive cylinder 20 and pivoted weighted members 50A, 50B, 50C. Such outer frame would include bearings to support rotation of the rotating members with respect to the outer frame.

Another modification could be made to the preferred embodiment of FIG. 1. Rather than linking the rotating members by an inner rotating cylinder or sleeve 26 as in the preferred embodiment, an outer rotating cylinder could be provided between disk 28 and drive cylinder 20. However, it is to be expressly understood that such modifications and adaptations are intended to be within the spirit and scope of the present invention as set forth in the following claims.

What is claimed is:

1. A device for restraining motion of exercise equipment comprising, a base, a supporting member secured to said base, exercise equipment having a user input means rotating means including a drive cylinder disposed with respect to said supporting member for rotation with respect to said supporting member and adapted to rotate about said supporting member in response to forces transmitted to said rotating means from said exercise equipment, bearing means disposed between said drive cylinder and said base for allowing said cylinder to freely rotate with respect to said base with respect to said supporting member, and a plurality of weighted members pivoted to said rotating means so as to pivot from a inner position when said drive cylinder is not rotating to a radially outer position in response to centrifugal force when said drive cylinder is rotating, whereby said device smoothly restrains bi-directional forces tending to rotate said rotating means at a higher angular speed more than forces tending to rotate said rotating means at a lower angular speed.

2. The device of claim 1 further comprising biasing means engaging said weighted members for selectively applying variable counter forces applied to said weighted members to restrain outward pivoting of said members in response to said centrifugal force.

3. The device of claim 1 wherein said drive cylinder includes an outer cylindrical surface adapted to accept a flexible cable being wrapped about said surface, whereby reciprocating members of exercise equipment when connected to said cable may drive said rotating means in alternating clockwise and counter-clockwise directions.

4. The device of claim 1 wherein said rotating means includes a drive cylinder having an outer peripheral surface adapted to accept a flexible cable wound about it, a sleeve secured to said drive cylinder at one end, a disk secured to an opposite end of said sleeve, said disk having a plurality of notches disposed about its outer periphery said notches being angularly spaced about said periphery of said disk; and said weighted members each have a connection head pinned within a respective notch of said disk so that each weighted member may pivot outwardly in its notch from said disk in response to centrifugal force of rotation of said drive cylinder.

5. The device of claim 4 wherein said bearing means is a roller bearing disposed between said drive cylinder and said base, said supporting member is a rod having upper and lower threaded portions, said rod is secured to said base at a lower end by a first threaded member threaded about said lower threaded portion of said rod, said disk carrying a second roller bearing disposed between a top surface of said disk and a second threaded member, and said second threaded member being threaded about said upper threaded portion of said rod.

6. The device of claim 5 further comprising a biasing plate disposed about said rod above said disk, said plate adapted to bear against said connection heads of said weighted members, a knob attached to an upper end of said rod, and a spring placed between said knob and said biasing plate, whereby, when said rod is screwed further into said first and second threaded members, said spring is compressed thereby applying further force against said biasing plate and said connection heads of said weighted members with the result that a biasing force is applied to said weighted members which resists outward movement of said weighted members in response to centrifugal force, thereby making said device less resistant to forces tending to rotate said drive cylinder, sleeve disk at a higher angular speeds.

7. Resistance apparatus for exercise equipment comprising, a support member exercise equipment having a user input means, a rotating assembly including weighted pivoting members disposed for rotation about said supporting member, and means connected to said rotating assembly for rotating said rotating assembly and said pivoting members with respect to said supporting member in response to bi-directional motion of said exercise equipment, said pivoting members being forced radially outward due to centrifugal force when said rotating assembly rotates, said pivoting members arranged with respect to said rotating assembly to increase the moment of inertia of said rotating assembly with respect to said supporting member with increasing angular velocity thereby smoothly increasing resistance to motion of said excerise equipment with increasing velocity of such motion.

8. The apparatus of claim 7 further comprising biasing means for increasing the amount of centrifugal force necessary for said pivoting members to be forced radially outward from said rod, thereby reducing the resistance of said apparatus to said motion of said exercise equipment with increasing velocity of such motion.

9. An exercise machine adopted to simulate cross-country skiing comprising a structure including two parallel rails, a foot pad disposed on each of said rails for reciprocating motion on its respective rail, and a resistance device including a supporting member a rotating assembly including weighted pivoting members disposed for rotation about said supporting member, a flexible cable connected to each of said foot pads and coupled to said rotating assembly for rotating said rotating assembly and said pivoting members about said supporting member in response to bidirectional reciprocating motion of said foot pads along said rails, said pivoting members being forced radially outward from said supporting member due to centrifugal force when said rotating assembly rotates, said pivoting members arranged with respect to said rotating assembly to increase the moment of inertia of said rotating assembly with respect to said supporting member with increasing angular velocity thereby smoothly increasing resistance to reciprocating motion of said foot pads with increasing velocity of such motion.

10. The exercise machine of claim 9 further comprising, biasing means for increasing the amount of centrifugal force necessary for said pivoting members to be forced radially outward from said supporting member thereby reducing the resistance of said resistance device to said reciprocating motion of said foot pads along said rails.

11. An exercise machine adapted to simulate stair climbing comprising, a base, two step members pivoted to said base, each step member arranged to pivot up and down with respect to said base in alternating fashion with the other step member, and a resistance device including a supporting member a rotating assembly including weighted pivoting members disposed for rotation about said supporting member, and a flexible cable connected to each of said step members and coupled to said rotating assembly for rotating said rotating assembly and said weighted pivoting members about said rod in response to up and down motion of said step members with respect to said base, said weighted pivoting members being forced radially outward due to centrifugal force when said rotating assembly rotates, said weighted pivoting members arranged with respect to said rotating assembly to increase the moment-of-inertia of said rotating assembly and weighted pivoting members with respect to said supporting member with increasing angular velocity thereby increasing resistance to up and down motion of said step members with increasing velocity of such motion.

12. The exercise machine of claim 11 further comprising, biasing means for increasing the amount of centrifugal force necessary for said weighted pivoting members to be forced radially outward from said supporting member thereby reducing the resistance device to said up and down motion of said step members with respect to said base.

* * * * *